US006735934B1

(12) United States Patent
Wabra et al.

(10) Patent No.: US 6,735,934 B1
(45) Date of Patent: May 18, 2004

(54) METHOD FOR FEEDING IN AND STARTING A THREAD AND FALSE TWIST TEXTURING DEVICE

(75) Inventors: Günter Wabra, Euerbach (DE); Hans-Dieter Scherpf, Hammelburg (DE); Klaus Schmidt, Wasserlosen (DE); Wolfgang Räder, Schonungen (DE)

(73) Assignee: TEMCO Textilmaschinenkomponenten GmbH, Hammelburg (DE)

( * ) Notice: Subject to any disclaimer, the term of this patent is extended or adjusted under 35 U.S.C. 154(b) by 0 days.

(21) Appl. No.: 09/913,489

(22) PCT Filed: Feb. 16, 2000

(86) PCT No.: PCT/EP00/01264

§ 371 (c)(1),
(2), (4) Date: Dec. 13, 2001

(87) PCT Pub. No.: WO00/49212

PCT Pub. Date: Aug. 24, 2000

(30) Foreign Application Priority Data

Feb. 16, 1999 (DE) ..... 199 06 325
Mar. 4, 1999 (DE) ..... 199 09 380

(51) Int. Cl.[7] ..... D02G 1/20
(52) U.S. Cl. ..... 57/284
(58) Field of Search ..... 57/282, 283, 284, 57/285, 286, 287, 288, 289, 290, 291, 292, 308, 309, 332–349, 351; 28/274, 276, 180, 182

(56) References Cited

U.S. PATENT DOCUMENTS 3,837,052 A 9/1974 Martin et al.
3,927,540 A 12/1975 Tanaka et al.
3,991,545 A 11/1976 Ritter et al.
4,022,006 A 5/1977 Howorth
4,100,660 A 7/1978 Nemecek et al.
4,138,840 A 2/1979 Greenway et al.
4,462,229 A 7/1984 Lafeber et al.
5,088,264 A 2/1992 Bartkowiak
5,193,334 A 3/1993 Dammann
6,026,636 A * 2/2000 Lorenz et al. ..... 57/290

FOREIGN PATENT DOCUMENTS

DE 2309418 8/1974
EP 0624208 B1 3/1998
GB 1379193 1/1975
GB 1492918 11/1977
WO WO 9532325 11/1995

OTHER PUBLICATIONS

International Preliminary Examination Report, Mar. 12, 2001.
German Patent Office Search Report, Aug. 16, 1999.
PCT Search Report, Jul. 25, 2000.

* cited by examiner

*Primary Examiner*—John J. Calvert
*Assistant Examiner*—Shaun R Hurley
(74) *Attorney, Agent, or Firm*—Dority & Manning, P.A.

(57) ABSTRACT

A process and device for texturing a thread within a false twist texturing device with a heat exchanger having thread passages formed by thread passage segments. The heat exchanger possesses a first section and a second section which form a chamber into which a fluid can flow to treat a thread during operation of the heat exchanger. The first and second sections of the heat exchanger can be manipulated to enlarge the thread passages to facilitate insertion of the thread. After the thread insertion, the heat exchanger is sealable in such a manner that the thread passages seal around the thread to prevent leakage of the fluid from the chamber while allowing the thread to be movable through the heat exchanger.

52 Claims, 5 Drawing Sheets

METHOD FOR FEEDING IN AND STARTING A THREAD AND FALSE TWIST TEXTURING DEVICE

BACKGROUND OF THE INVENTION

The present invention concerns a method for the insertion and starting of thread in a false-twist texturing device, which device possesses a fluid containing heat exchanger with at least two passages for the leading through of thread and for the sealing of the heat exchanger. Moreover, the present invention relates to a false-twist texturing device with a heat exchanger having at least two thread passages for the conducting of the thread therethrough and for the sealing of the heat exchanger.

EP 0 624 208 B1 discloses a texturing device, in which heat exchangers are provided. The heat exchangers are installed for optional service as a heating apparatus or as a cooling apparatus. In each case fluid, hot or cold, is brought into contact with the thread. The fluid, in this operation, finds itself in a chamber through which fluid is continually flowing. The chamber is essentially constructed in tubular form and possesses small borings, through which the thread is brought into and out of the vessel. An exchange of heat is effected by means of the contact of the thread with the fluid. If the fluid is warmer than the thread, then the thread is warmed. If the fluid is cooler than the thread, the thread is cooled. Although this known apparatus operates satisfactorily, a disadvantage lies therein, in that in the case of a thread break, or if a restart of the texturing of the thread in the tubular vessel becomes necessary, then the thread must be reintroduced into the tubular vessel. This is very expensive in time and money, since, in order to restart the process, the thread must be inserted through very small openings in the tubular chamber. These starting operations in the case of this known apparatus is thus complicated and time consuming.

OBJECTS AND SUMMARY OF THE INVENTION

Thus, a principle object of the present invention is to create a process and an apparatus, wherein the insertion and the starting, that is, the restart of the texturing process, can be carried out quickly, simply and reliably. Additional objects and advantages of the invention will be set forth in part in the following description, or may be obvious from the description, or may be learned through practice of the invention.

This above described object is achieved by a method in accord with the generic method, in which the thread passages are increased in size for the introduction of the thread. By means of the increased size of the thread passages, it becomes possible in a simple manner to insert the thread into the heat exchanger. The danger of a blockage of the thread passages is assuredly avoided with this arrangement. If, in an advantageous formulation of the invention, the thread passages are separable in an axial and/or radial direction for the introduction of the thread, and are thereupon closed following the introduction of thread, an especially simple and problem-free entry of the thread becomes possible. Where this procedure is concerned, the narrowly confined thread passages are opened, and thus, in a very simple manner, it becomes possible to lay the theread in an opened groove instead inserting it into a restricted, small opening. The thread, so inserted, by the subsequent closure of the thread passages, is once again totally enclosed in the passages, since the once exposed groove becomes a fully circumferentially enclosed passage upon being closed. The insertion of the thread by this method is very rapid, simple and reliable to carry out.

An object of the invention is further achieved, in that the thread, by means of an auxiliary air flow through the thread passages, is either blown or sucked through the thread passages.

By means of a corresponding arrangement of air nozzles, which empower the auxiliary air flow through the thread passages, the thread is entrained in the air flow and carried through the thread openings. In this case, obviously, an opening of the thread passages is not required and the entry and subsequent thread-start is thus activated by an especially simple, constructive apparatus. The auxiliary nozzles can be placed at each thread passage and thus act in the manner of a progressive nozzle arrangement, whereby the thread is carried along from nozzle to nozzle.

Further, the purpose of the invention will be achieved, in that the thread is pulled through the thread passages by means of an awl. In many cases of insertion in which the auxiliary air flow might not be sufficient, by means of an awl, which has been previously pushed through the thread passage, the thread can be captured thereon and then pulled through the thread passage. In many applications, this can be an advantage, since a mechanical guidance is available for the thread and the insertion is clearly made easier thereby.

In order to prevent the fluid of the heat exchanger escaping from the heat exchanger through the thread passages, in accord with the invention, a second fluid flow, in particular an air flow, restrains the first fluid from access to the thread passages. This second fluid flow, specifically an air flow, enters the heat exchanger in the area of the thread passages and accordingly generates a flow, that is, a pressure, which acts contrary to the escape tendency of the first fluid. In this way, an active sealing off of the thread passages is accomplished, so that the heat exchanger can even be so constructed, that the thread passages are placed in a vertical direction.

In order to prevent the first fluid from running out of the heat exchanger upon the insertion of the thread, provisions are made that, before the insertion of the thread (i.e., before the opening of the heat exchanger), the feed of the first fluid and/or the second fluid is interrupted and the fluid in the heat exchanger is removed. By this means, a simple insertion, or a guiding of the thread into the heat exchanger now empty of fluid, is possible. Thus, simple methods of insertion of thread now encompass both the use of an auxiliary flow of air as well as the opening of the heat exchanger.

To allow the thread to pass through the heat exchanger in a manner as free as possible from stress and thereby to avoid a thread break, provisions are made so that the thread travels only at a restrained speed after the inlay or insertion of the thread and then is increased to the operational level. In this way, the force, which the fluid exerts on the thread, is gradually increased so that a thread break is avoided.

The object will also be achieved by a false twist texturing device with a heat exchanger with at least two thread passages for the passage of the thread and for the sealing of the heat exchanger. In this case, the heat exchanger is separated along the direction of the thread movement, and the parts which allow the simple inlay of the thread can be parted one from the other. With an apparatus of this description, it is possible to open the heat exchanger so far that the thread can be inserted into the heat exchanger. The thread passages are made simple to access by the opening of the heat exchanger, so that the thread, in accord with the formation of the thread passage can be guided into the thread passages or laid across them with simple means. Following this inlay or insertion of the thread into the thread passages, the heat exchanger can be again closed, whereupon it is ready for operation. The complicated threading of the thread through the complete heat exchanger from the thread inlet to the thread outlet, as is necessary in the state of the technology today, is advantageously no longer required because of the invented method.

In the case of a separable heat exchanger, as well as where a single piece heat exchanger is concerned, provisions can be made for an injector nozzle to be placed before and/or after the individual thread passages at the respective inlet and/or outlet to transport the thread through the thread passage. The injector nozzle produces such an effect, that according to the passage design, the thread is guided through the thread passages by means of either a blowing or a suction action. The injector nozzle, for this action, can be integrated into the heat exchanger or principally brought to the heat exchanger when a thread input procedure is called for. If seen as advantageous, an individual nozzle can be installed in front of each thread passage and another following the thread passage to achieve a reliable insertion of the thread. Often it suffices to simple place an injector nozzle at the first and/or the last thread passage of the heat exchanger, whereby the thread can be blown or sucked through the heat exchanger.

If, within the heat exchanger, the thread inlet and the thread outlet are connected by a tube with passages radially situated along its length, then the air flow with which the thread is brought through the thread passages also flows through the heat exchanger. In this way, the thread is mechanically led through the heat exchanger. By means of the passages in the tube, assurance is provided that the fluid in the heat exchanger comes into sufficient contact with the thread.

If the thread passages are made in segments that are individually movable in reference to one another, so that the thread passages can open in an axial or a radial manner for the insertion of the thread, then an especially simple inlay of the thread is accomplished. Because the thread grooves of the segments are circumferentially constituted so that the thread in one of the segments per thread passage is laid in one groove, and subsequently the thread passage is closed to match a corresponding groove of another segment, then, in operation, an excellent placement of the thread has been accomplished as well as an effective sealing action of the thread passages relative to the active fluid of the heat exchanger. In other words, the segments are, in accomplishing this operation, separated from one another for the inlay of the thread, and, after the inlay of the thread, are brought into alignment again, so that the circumferential capture of the thread in the passage is carried out by this means. Frequently, it suffices if the two coacting segments are arrayed in an axial direction, one behind the other, and abutting one another on one side to maintain a satisfactory sealing action.

In a particularly advantageous embodiment, the segments relate to one another in a rotatably arranged, circular part of the thread passage. With this arrangement, in a particularly simple manner, the opening of the thread passage for the inlay of the thread and the subsequent closure of the thread passage makes possible a circumferential capture of the thread.

In order to bring about an advantageous sealing action in the axial direction of the individual segments, at least one of the coacting, individual segments is loaded by a spring against the corresponding segment. The side surfaces of the segments engage against one another in a substantially sealing manner, so that the fluid present in the heat exchanger is essentially prevented from penetrating backward through the thread passage. By means of this spring loaded placement of at least one of the segments, the opening and the closing of the thread passages is made easier, and the tolerances which must be maintained in the process of manufacture are less demanding. Thereby, a simple and enduring, tight closure ability of the thread passage can be effected.

In order to prevent a loss of the fluid present in the heat exchanger, provisions have been made so that at least the chamber of the heat exchanger in which the first fluid is to be found is sealed by means of a peripheral sealant. When this is done, the opening and closing of the heat exchanger is advantageously possible for a longer period without the loss of the heat transfer fluid, which fluid, for example, would have to be retained in separate tanks.

In order to achieve an especially effective temperature exchange between the fluid and thread, provisions have been made that the flow of fluid through the heat exchanger proceeds in counterflow to the progress of the thread therethrough. Experience has shown, that in such opposite movement, the thread approaches the temperature of the fluid essentially more rapidly. The length of the heat exchanger on this basis can be reduced under certain temperature differences and exchange dwell time. Alternatively, the transport velocity of the thread through the heat exchanger may accordingly be increased. In general, it has been established, that it is advantageous for the fluid flow through the heat exchanger to be provided with velocity components which are relative to differing thread velocity components.

If the fluid flow is in a direction essentially contrary to the pull of gravity, then a particularly simple possibility for the through-flow is produced.

In order to attain a particularly effective sealing action in the area of the thread passages and to prevent the issuance of the fluid from the heat exchanger at, these passage points, the invention provides that more than one, preferably three, thread passages are positioned at the thread inlet and/or thread outlet. By this means, a kind of a labyrinthine sealing means can be installed which reliably assures that the heat exchanger is tight. In this way, it is even possible to place the heat exchanger in a vertical position, so that the thread inlet or outlet can be located under the fluid container of the heat exchanger.

In order to simplify the insertion of the thread, especially in the case of injector nozzles, provisions have advantageously been made, so that the thread passage is equipped with a chamfered entry to accept the thread insertion. In this way, the flow and the thread are so guided, that the thread penetrates the openings of the thread passages without difficulties and a thread blockage within the heat exchanger is avoided.

Since the thread runs through the thread passage at very high speeds, it is particularly advantageous, if the thread passage is designed to be wear resistant. In this regard, ceramics have proven themselves especially advantageous, in that first, they, show a high wear resistance in regard to the thread, and second, the thread passes through essentially in an undamaged condition.

In order to prevent the heat exchanger from accidentally opening, especially when there is still fluid in the heat exchanger, it is advantageously provided that the heat exchanger can be locked, especially mechanically, electrically, hydraulically or pneumatically. Only upon a signal that opening is permissible after an emptying of the heat exchanger, would it be possible for the heat exchanger to be opened manually or automatically.

It is particularly advantageous if the fluid is water and specifically, distilled water, so that an especially more rapid and simpler heat transfer can take place. Water contact is not a negative influence on the thread and permits either a protective cooling or heating of the thread to a currently desired temperature. Beyond this, the water is economical to use and creates no problems if the heat exchanger, in case of damage, loses its sealing and the fluid escapes.

If the fluid possesses thread treatment additives and/or a specified degree of hardness, then the thread, on an optional basis, can be treated during the texturing procedure or be especially prepared for further processing.

Great advantages have arisen, when a fluid, particularly water, is used which has been enriched or saturated with a scrooping agent. By this means, the thread receives great protection in subsequent treatment, and a washing-out of the thread is prevented. In this way, a very high quality thread is produced.

If the fluid possesses a specified temperature, then the temperature change of the thread likewise can be predetermined from the dwell time of the thread in the heat exchanger. By means of a change in the temperature of the fluid, then correspondingly, changes in the temperature of the thread can be effected. In this way, a balancing can be made when the thread enters into the heat exchanger at different temperatures or the temperature of the thread is too high or too low at the thread exit. By a temperature change of the fluid, in these cases, the thread can be held at a uniform temperature.

For the support of the labyrinthine sealing means at the thread inlet and outlet passages, the invention provides another fluid, preferably air, to be admitted in the area of the passages for the sealing of the heat exchanger and/or for the drying of the thread. The air acts in this manner, especially when at a certain pressure, perhaps lower than 5 bar, preferably 0.5 bar, against the first fluid in the heat exchanger and prevents the first fluid from migrating through the thread passages. In this way, a particularly tight sealing of the heat exchanger is attained. As a further effect, the drying of the thread is carried out by this second fluid, especially when it is air or another gaseous medium. By the above mentioned means, a leakage of the first fluid of the heat exchanger to the outside of the heat exchanger, and the consequent contamination of the surroundings is reliably avoided. In particular, the effect of the drying of the thread has proven itself as being extraordinarily positive, since even the further workup of the thread can be carried out without difficulties. The disadvantage of the previously employed, fluid-using heat exchangers is reliable avoided, by the above means, and in accord with the invention.

In a further embodiment in accord with the present invention, the heat exchanger is variable in its length, in this case being telescopically constructed. By this means, the dwell time of the thread in the heat exchanger can be correspondingly variably set. This concept of the heat exchanger, realized here for the first time with a variable length, leads to particularly favorable operational characteristics, since the heat exchanger can now be very simply adapted to the current application. If the contact positions of two telescopic parts of the heat exchanger are likewise supplied with a sealing means, then also in this situation, an effective sealing is achieved for the chamber in which the first fluid is contained. Obviously, there are other sealing possibilities which can be put into use, for instance, a casing of variable length inside the heat exchanger where the first fluid is held.

Further advantages of the present invention are described in the following descriptions of embodiments with the aid of the drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
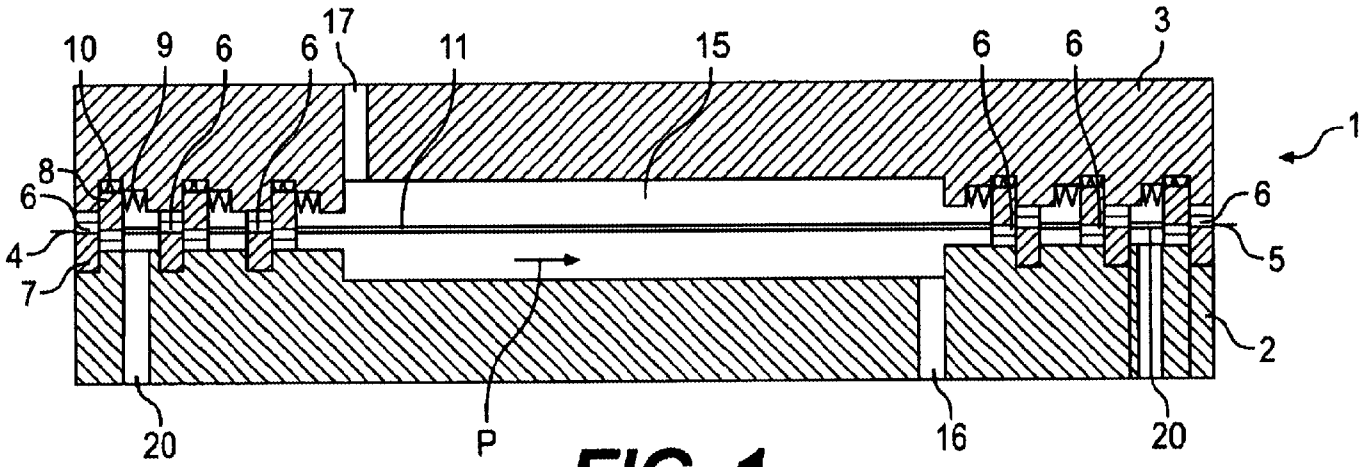
FIG. 1 shows a longitudinal section through a heat exchanger.

In FIG. 1, a heat exchanger 1 is presented in sectional view. The heat exchanger 1 possesses an under-part 2 and an upper-part 3, which can be separated, one from the other. Between the under-part 2 and the upper-part 3 is placed a thread inlet passage 4 and a thread outlet passage 5. Between the under-part 2 and the upper-part 3 is a plurality of thread passages 6. Each of the thread passages 6 comprises two segments 7 and 8, respectively. The segment 7 is rigidly and immovably fixed in the lower part 2. The segment 8 in the upper-part 3 is designed to be movable in the axial direction of the thread passage 6. To accomplish this properly, the segment 8 is loaded by a spring 9 which finds abutment against a surface of the upper-part 3 and causes the segment 8 to press against a surface of the segment 7 in such a way, that it brings about a substantial sealing action. Segment 7 and segment 8 form together the thread passage 6, which has a diameter of normally less than a tenth of a millimeter. Between the upper-part 3 and the segment 8 is found, moreover, a seal, which contributes to the fact that the entire system predominately prevents the fluid contained in the heat exchanger 1 from migrating out of the heat exchanger 1. On the contact surface between the under-part 2 and the upper-part 3, another sealant is provided, which completely seals off the heat exchanger in its closed position and thus, again, prevents the escape of fluid from the interior of the heat exchanger 1.

The fluid in the heat exchanger 1, which is provided for heat transfer to the thread, is to be found in a fluid chamber 15. The thread, which runs through this fluid chamber 15, thus comes into heat exchanging contact with the fluid. The fluid is in constant flow through the fluid chamber 15, so that there is always a fluid available, which is predominately at the desired specified temperature and thus provides defined relationships for the heat exchange with the thread. The flow through the fluid chamber is carried out by the fluid being admitted into the fluid chamber 15 at an inlet 16, and correspondingly, leaving the fluid chamber 15 through an outlet 17. This brings about a through-flow in the fluid chamber 15 in a direction from the inlet 16 to the outlet 17. The thread runs through the heat exchanger 1 in the direction of the arrow P, so that a counterflow situation exists between the thread and the flowing fluid. The counterflow brings about a more rapid and effective heat transfer between the thread and the flowing fluid.

In order to effectively prevent the fluid, which predominately would be of a liquid nature, from escaping the fluid chamber 15 in the direction of the thread passages 6, besides three-fold thread passages 6, further measures are taken, both at the thread inlet 4 as well as at the thread outlet 5. Thus, between a pair of thread passages 6 at the thread inlet 4, and again, between a pair of thread passages 6 at the thread outlet 5, an additional fluid, which is especially of a gaseous nature, is introduced between the passages 6 of each pair. For this purpose, a conduit 20 is provided in the under-part 2, through which the second fluid is introduced into the space between the two thread passages 6. This second fluid, which, for instance, will be introduced at a pressure of 0.5 bar, serves for a pressure buildup between the thread passages 6 and attempts to penetrate through the thread passages 6. At this point, then, a resistance is presented to the first fluid, whereby the first fluid is effectively blocked from escape from its confinement in the fluid chamber 15. In particular, the second gaseous fluid, which, in the simplest case, is air, moreover can be utilized to dry the thread. The first fluid of the heat exchanger 1, which is still adhering to the thread, is pneumatically wiped off of the thread by the air so to speak. The thread upon its exit from the heat exchanger 1 is largely in the dry state. This brings about, in an advantageous way, a very good future workability of the thread. At the same time, the effect of the air prevents dirt accumulation on the thread outside of the heat exchanger 1 as well as the loss of the first fluid from the heat exchanger by leakage along with the thread.

Figure 2:
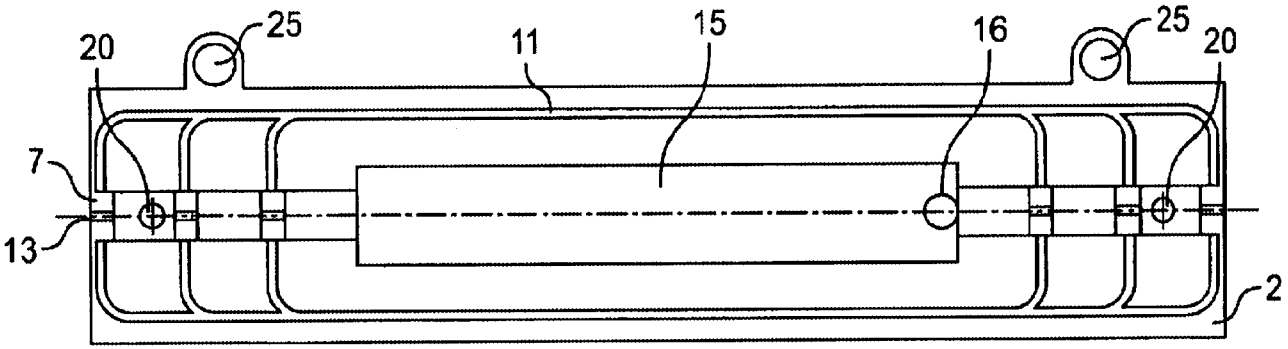
FIG. 2 shows a plan view of an under-part of the heat exchanger.

FIG. 2 shows a plan view of the under-part 2 of the heat exchanger 1. In this view, in particular, the layout of the sealing means 11 is visible. The sealing means 11 is placed, so that the escape of the fluids at the separation plane of the upper-part 3 and the under-part 2 is assuredly avoided. For this purpose, the sealing means 11 in the area of the thread passages 6, i.e., the segments 7, is divided into multiple parts, so that a fluid, which has found its way through a first thread passage 6, is blocked at this point from a complete escape from the heat exchanger 1.

The segments 7 exhibit slots 13 in which the thread in the open state of the heat exchanger 1 is laid in place. Upon the closing of the heat exchanger 1 by the joining together of the under-part 2 and the upper-part 3, the upper segments 8 are brought into contact with the under segments 7 in such a manner that the thread passage 6 is created. In this way, first, an optimal guidance of the thread into the thread passage 6 is made possible, and second, a very simple possibility is realized of inserting the thread into thread passage 6 of the heat exchanger 1.

The joining together of the under-part 2 and the upper-part 3 of the heat exchanger 1 is carried out in the present embodiment in accord with guides 25. These guides 25 are placed on the under-part 2 and alignigly correspond to complementary components of the upper-part 3. The guides 25 effect a linear arrangement, along which the upper-part 3 can be separated from the under-part 2, and then can be exactly reassembled.

Figure 3A:
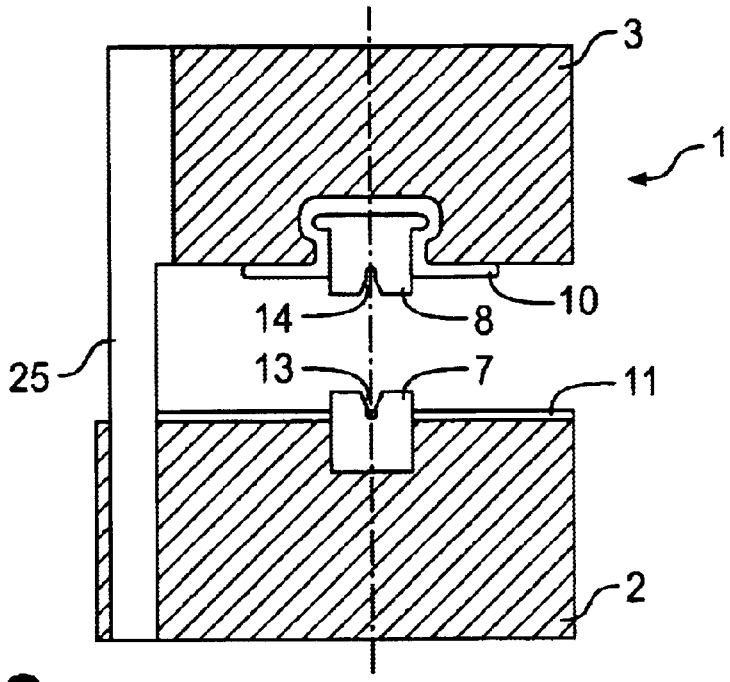
FIG. 3*a* shows an opened heat exchanger.
Figure 3B:
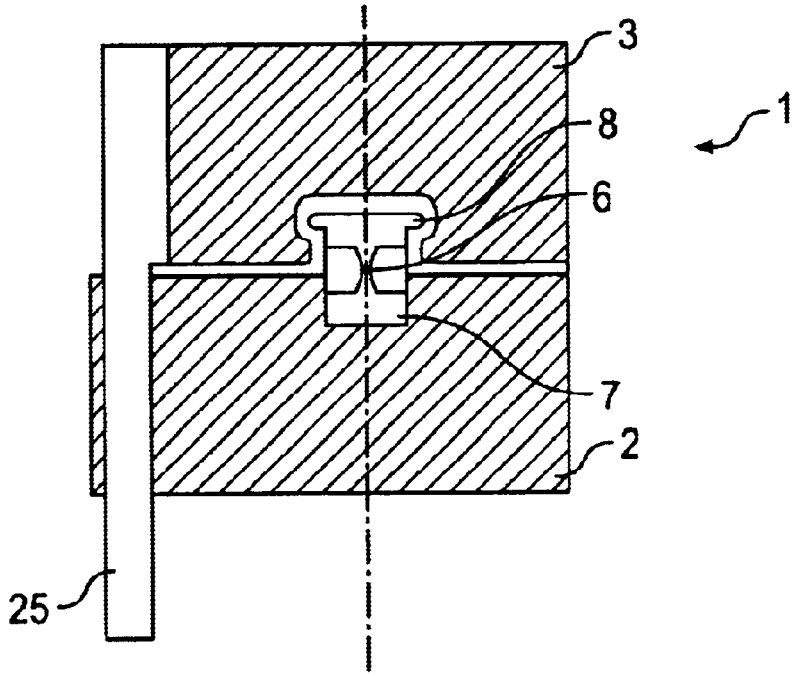
FIG. 3*b* shows a heat exchanger of the type in 3*a* in the closed condition.

FIG. 3*a* and FIG. 3*b* demonstrate the functional action of a heat exchanger 1 as is shown in FIGS. 1 and 2. In FIG. 3*a*, the heat exchanger 1 is shown in its open condition. The upper-part 3 is distanced from the under-part 2 by means of the guide 25. In this situation, the segments 7 and 8 are freely accessible. The segment 7 possesses a slot 13 and the segment 8 a slot 14. In this case, chamfered edges are furnished, which ease the insertion of the thread in the slot 13. After the thread is laid in place, the under-part 2 and the upper-part 3 are again joined together by the guide 25. As this is done, the situation is that the segments 7 and 8 are behind one another, and by means of the overlapping of the slots 13 and 14, an opening is formed with an essentially circular shape. This formed shape now becomes a thread passage 6.

By means of the sealing means 10 and 11, as well as due to the fact that the segment 8 is pressed against the segment 7 by means of the spring shown in FIG. 1, again a tight seal is formed to repress the fluid in the chamber 15 of the heat exchanger 1 from escaping therefrom. On the other side, the remaining opening, which forms the thread passage 6, is large enough to allow the thread to be inserted without difficulty into the heat exchanger 1 and to be again brought out through the thread outlet 5.

In order to avoid abrasive wear on the segments 7 and 8, or at least to hold such wear to a minimum, the segments 7 and 8 are made of a wear resistant material. Showing itself as particularly well adapted to such resistance, ceramics have been chosen as the material.

Although the segment 7 is rigidly affixed in the under-part 2, the segment 8 in the upper-part 3 is designed to be movable in an axial direction of the thread passage 6. For this purpose, the segment 8 is constructed, so that in the presentation of FIG. 3*a*, a projection on both sides is made evident, which prevents the segment 8 from loosening upon the removal of the upper-part 3 from the under-part 2. At the same time, the projection permits the axial sliding movement of the segment 8.

Figure 4A:
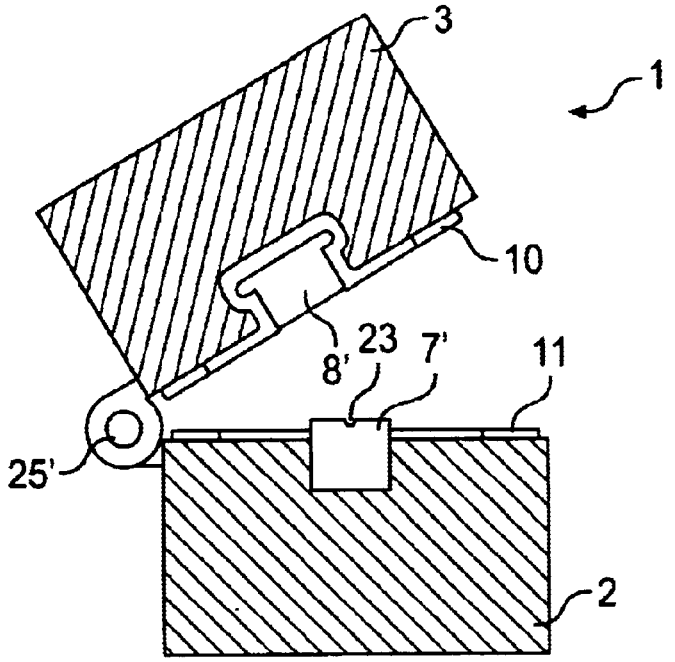
FIG. 4*a* shows an opened heat exchanger.
Figure 4B:
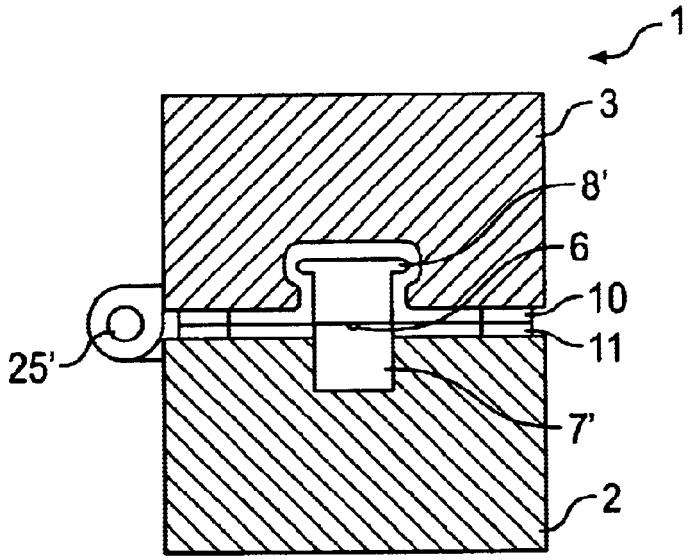
FIG. 4*b* shows a heat exchanger of the type in 4*a* in the closed condition.

FIGS. 4*a* and 4*b* show an altered version of the heat exchanger 1 as compared to the embodiment of the FIG. 1 to 3. In FIG. 4*a*, once again the open condition of the heat exchanger 1 is depicted. Under-part 2 and the upper-part 3 are hingedly connected with one another by means of a pivot pin 25', so that the upper-part 3 can be swung away from the under-part 2. The segment 7', which, fundamentally is constructed in similar manner to segment 7, possesses a longitudinal groove 23. In this groove 23, when the heat exchanger is open, the thread can be laid in. The segment 8' possesses neither groove nor slot in this embodiment, but is made with a smooth flat surface which is presented at the contact area with the segment 7'. When the parts 2 and 3 are again swung together, so are the segments 7' and 8' pressed together. In this case, the situation is different than in the previous embodiment, where the segments were placed one behind the other. These segments 7' and 8' close one upon the other and, because of the groove 23, form a thread passage in their combined condition. In this embodiment, the axial freedom of movement of the upper segment 8' can be eliminated, since no mutual pressing together of the segments 7' and 8' is necessary. The sealing is made exclusively by the pressing together of the segments 7' and 8' in a radial direction.

Figure 5A:
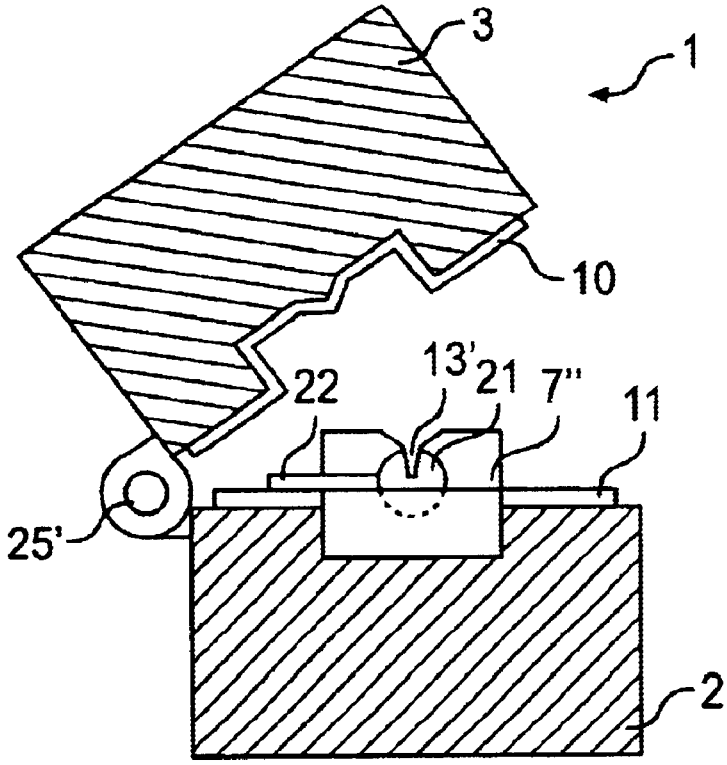
FIG. 5*a* shows an opened heat exchanger.
Figure 5B:
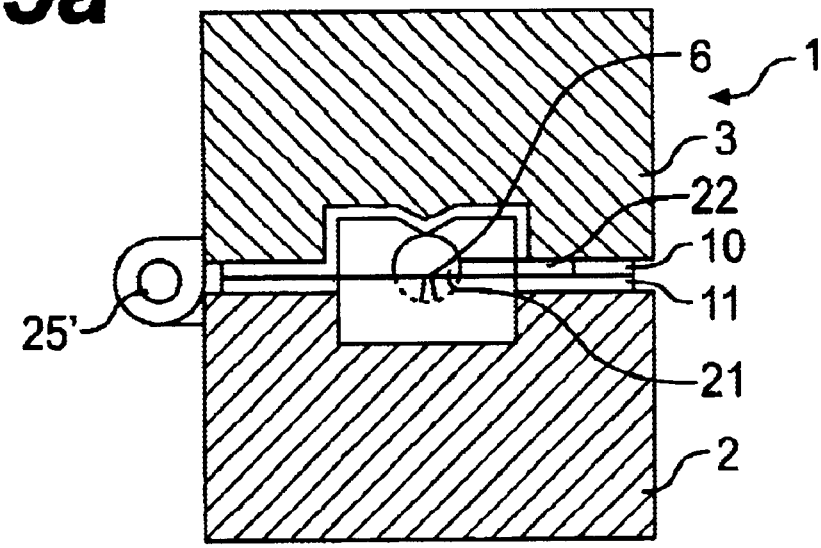
FIG. 5*b* shows a heat exchanger of the type of 5*a* in the closed condition.

FIGS. 5*a* and 5*b* show another embodiment of the heat exchanger 1. In this case, principally a segment 7" is provided. The segment 7" is placed in the under-part 2, which exhibits a rotatable part 21. In the rotatable part 21, a slot 13' is available in which the thread can be placed when the heat exchanger 1 is open. After the thread is laid therein, then the rotatable part 21, by means of the lever 22 is turned 180° so that the slot 13' is now turned downward. In this way, by the coaction with the segment 7", the slot 13' is changed to a narrow thread passage 6. The lever 22, is secured by means of an edge of the upper-part 3, so that an unintended opening of the thread passage 6 is avoided. The construction in accord with this design permits a very advantageous and simple insertion of the thread into the heat exchanger 1, since any monitoring as to whether or not the thread is placed correctly and is mobile in the thread passage 6 can be checked in the open condition of the heat exchanger 1. Under these last stated circumstances, small corrections, such as a changed inlay of the thread in the thread passage 6, are possible in a more simple manner than in the case of the previously described embodiments, wherein the thread passage 6 is formed only after the complete closure of the heat exchanger 1.

Figure 6:
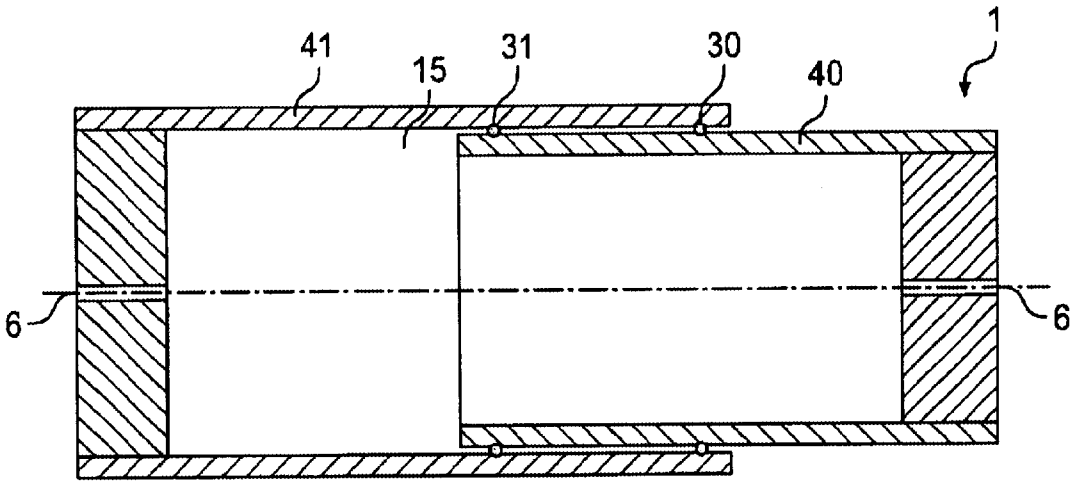
FIG. 6 shows a heat exchanger of variable length.

FIG. 6 shows a heat exchanger 1 in a simplified presentation. The heat exchanger 1 in this embodiment is telescopically changeable in its length. The heat exchanger 1 is here comprised of essentially an inner tube 40 and an outer tube 41, which are respectively slidable, one within the other. In order that the fluid is retained securely in the fluid chamber 15, seals 30 and 31 are provided, which are inserted between the inner tube 40 and the outer tube 41. These seals are so arranged that they maintain their sealing ability upon a sliding of the inner tube 40 and the outer tube 41. The telescopic in and out sliding of the inner tube 40 and the outer tube 41 changes the length of the heat exchanger 1. First, the advantageous aspect of this ability to change the length of the heat exchanger is that the dwell time of the thread in the heat exchanger 1 at a constant running rate is variable. By this design, a variable heat transfer between the thread and the fluid in the fluid chamber 15 can now be arranged. Second, a further advantage of this embodiment is that, for the insertion of the thread through the thread passages 6 of the heat exchanger 1, the heat exchanger 1 can be collapsed to its minimium length, whereupon the thread passages 6 are at a minimal distance, one from the other. By this means, insertion of the thread through the thread passages 6 is essentially eased. Further, the guidance, for instance by auxiliary air flows, which can be directed through the thread passages 6, becomes more simple, since the distances, which must be based on the thread position, are smaller. The insertion of the thread in the heat exchanger 1 is thus enabled to be easier, quicker, and more reliable.

Figure 7:
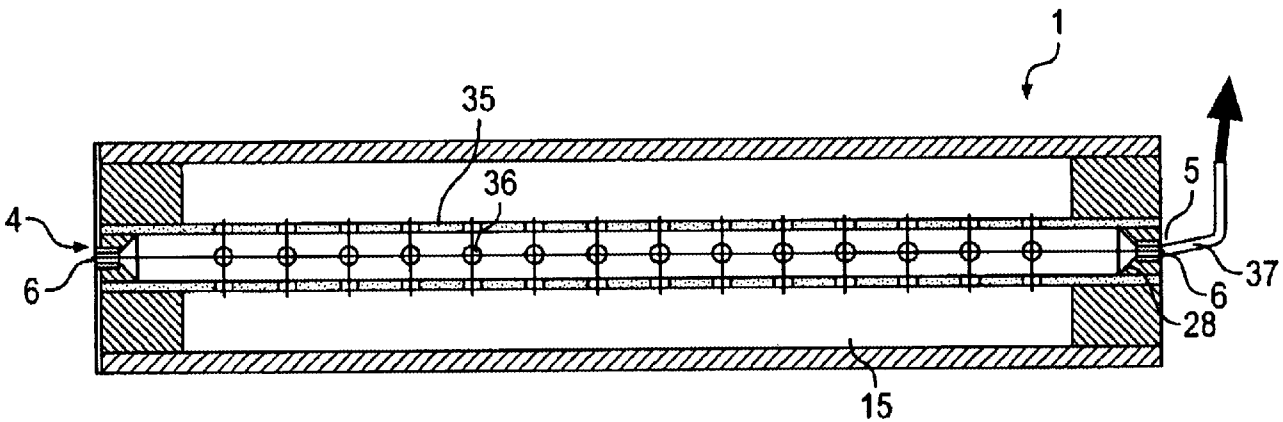
FIG. 7 shows a heat exchanger with an internal guide tube.

FIG. 7 shows a further heat exchanger 1, presented as a sketch. Between the thread passages 6 is placed a tube 35. The tube 35 exhibits openings 36. The fluid from the fluid chamber 15 can penetrate into the tube 35 through the openings 36, and in this way, come into heat transferring contact with the thread which is being conducted through the tube 35. The tube 35 also serves for the simple insertion of the thread into the heat exchanger 1. The thread, in this case, is inserted into the thread passage 6 of the thread inlet 4, and by means of a suction connection 37 is pulled through the tube 35. By means of the tube 35, the thread is better conducted in the suction induced air flow, so that a secure inspiration and insertion of the thread in the heat exchanger 1 becomes possible. In order to simplify the insertion of the thread into the thread passage 6 at the thread exit 5, a chamfering 28 is provided. By means of the chamfer 28, the thread is directed unmistakably to the thread passage 6 and a thread blockage in the tube 35 is advantageously avoided. If necessary, the thread passage 6 can also be enlarged for the insertion of the thread and then restricted to the original diameter after the insertion of the thread. This is done, for example, by means of the described measures for the change of the thread passages.

Obviously, the features of the described embodiments may be combined among themselves. Both the first fluid as well as the second fluid can be liquid, gas or vaporizing in character. The fluid can be colder or warmer than the thread, whereby the heat exchanger 1 can take on the role of either a cooler or a heater as is appropriate. If the heat exchanger is employed as an active cooler, then the fluid is generally liquid in nature. On the other hand, when the heat exchange equipment is used as a heating apparatus, more likely steam is employed in the heat exchanger 1.

For achieving a better circulation about the thread, the fluid should be in turbulent flow. The fluid can also be in a flow directed at right angles to the run of the thread.

The invention is not limited to the presented embodiments here described. Thus, it is also possible, that the upper-part and the lower part of the heat exchanger can be forced in an axial direction against one another and thereby the segments would be distanced, one from the other, so that the passage for the thread is increased.

It can also be provided, that the function parts of the apparatus are employed only in one component of the device, so that a constructive, simple, and economical construction is possible. Valves and controls for the operation of the device can be installed advantageously for their placement as a compact, modular component on the housing of the heat exchange apparatus.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A process for texturing a thread within a false twist texturing device with a heat exchanger, said process comprising the steps of:

separating the heat exchanger in a manner so that thread passages formed within the heat exchanger are enlarged;

inserting the thread into the heat exchanger and thread passages in such a manner that the thread extends through the heat exchanger;

sealing the heat exchanger so that the thread passages seal around the thread providing enough space around the thread so that the thread is movable;

flowing a first fluid through a chamber formed by the heat exchanger between the thread passages; and moving the thread through the heat exchanger as the fluid flows through the chamber to treat the thread.

2. A process as in claim 1, further comprising the step of sucking the thread through the thread passages by means of an auxiliary airflow.

3. A process as in claim 1, further comprising the step of blowing the thread through the thread passages by means of an auxiliary airflow.

4. A process as in claim 1, wherein the thread is pulled through the thread passages by an awl.

5. A process as in claim 1, wherein the heat exchanger is opened in an axial direction to separate the thread passages for the insertion of the thread.

6. A process as in claim 1, wherein the heat exchanger is opened in a radial direction to separate the thread passages for the insertion of the thread.

7. A process as in claim 1, further comprising interrupting the flow of the first fluid and removing the first fluid from the heat exchanger before the opening of the heat exchanger.

8. A process as in claim 1, further comprising flowing a second fluid within the heat exchanger around an area of the thread passages to facilitate the sealing of the first fluid within the chamber by the flow of the second fluid obstructing the flow of the first fluid from the thread passages.

9. A process as in claim 8, wherein the second fluid is air.

10. A process as in claim 8, further comprising interrupting the flow of the first fluid and the second fluid and removing the first fluid and second fluid from the heat exchanger before the opening of the heat exchanger.

11. A process as in claim 1, further comprising increasing the velocity at which the thread moves through the heat exchanger from a reduced velocity after insertion of the thread to an operational velocity.

12. A process for texturing a thread within a false twist texturing device with a heat exchanger, said process comprising the steps of:

manipulating the heat exchanger in a manner so that thread passages formed within the heat exchanger are enlarged;

inserting the thread into the heat exchanger and thread passages in such a manner that the thread extends through the heat exchanger;

sealing the heat exchanger so that the thread passages seal around the thread providing enough space around the thread so that the thread is movable;

flowing a first fluid through a chamber formed by the heat exchanger between the thread passages;

moving the thread through the heat exchanger as the fluid flows through the chamber to treat the thread; and wherein the thread passage opens radial to facilitate the, insertion of the thread.

13. A texturing device for texturing a thread with a false twist, said device comprising:

a heat exchanger for transferring heat to said thread, said heat exchanger having a first section and a second section operably disposed to one another and forming a chamber into which a first fluid flows to treat said thread;

at least two thread passage segments operably disposed to said first and second sections of said heat exchanger, said thread passage segments forming thread passages through which said thread is movable within said heat exchanger;

wherein said first and second sections of said heat exchanger are separable and closable along the thread path in such a manner that said thread passages formed by said thread passage segments are enlarged to facilitate insertion of the thread into said heat exchanger; and wherein said first and second sections of said heat exchanger are sealable in such a manner that said thread passages formed by said thread passage segments seal around said thread to prevent leakage of said first fluid from said chamber while allowing thread to be movable through said heat exchanger.

14. A device as in claim 13, further comprising at least one injector nozzle operably disposed to an inlet thread passage formed by said thread passage segments to facilitate conduction of said thread through said thread passages.

15. A device as in claim 13, further comprising at least one injector nozzle operably disposed to an outlet thread passage formed by said thread passage segments to facilitate conduction of said thread through said thread passages.

16. A device as in claim 13, further comprising at least one injector nozzle operably disposed to an inlet thread passage and an outlet thread passage formed by said thread passage segments to facilitate conduction of said thread through said thread passages.

17. A device as in claim 13, wherein said thread passage segments are separable from each other.

18. A device as in claim 13, wherein said thread passage segments are a rotatably arranged circular component.

19. A device as in claim 13, wherein said thread passage segments are operably disposed one after another in the direction of travel of said thread.

20. A device as in claim 13, wherein pressure is exertable by at least one pair of coacting thread passage segments through a spring operably disposed to one of said coacting thread passage segment.

21. A device as in claim 13, wherein said chamber of said heat exchanger is sealed by a sealing agent.

22. A device as in claim 13, wherein said first fluid flows through said heat exchanger at a different velocity relative to the thread velocity as said thread travels through said heat exchanger.

23. A device as in claim 22, wherein said first fluid flows in the opposite direction of the direction of travel of said thread through said heat exchanger.

24. A device as in claim 22, wherein said first fluid flows in a direction counter to the direction of gravity.

25. A device as in claim 13, wherein at least two thread passages formed by said thread passage segments are disposed at an inlet of said heat exchanger.

26. A device as in claim 13, wherein three thread passages formed by said thread passage segments are disposed at an inlet of said heat exchanger.

27. A device as in claim 13, wherein at least two thread passages formed by said thread passage segments are disposed at an outlet of said heat exchanger.

28. A device as in claim 13, wherein three thread passages formed by said thread passage segments are disposed at an outlet of said heat exchanger.

29. A device as in claim 13, wherein said thread passage segments form an entry chamfer operably disposed to said thread passages formed by said thread passage segment.

30. A device as in claim 13, wherein said thread passage segments are resistant to wear from said thread traveling through said thread passages formed by said thread passage segment.

31. A device as in claim 13, wherein said heat exchanger is at least one of mechanically, electrically, pneumatically, and hydraulically lockable.

32. A device as in claim 13, wherein said first fluid is water.

33. A device as in claim 32, wherein said first fluid is distilled water.

34. A device as in claim 32, wherein said first fluid includes thread influencing additives.

35. A device as in claim 32, wherein said first fluid includes prespecified degree of hardness.

36. A device as in claim 32, wherein said first fluid includes a scrooping agent.

37. A device as in claim 32, wherein said first fluid exhibits a prespecified temperature.

38. A device as in claim 13, wherein a second fluid flows within said heat exchanger around an area of said thread passages formed by said thread passage segments to facilitate the sealing of said first fluid within said chamber by said flow of said second fluid obstructing the flow of said first fluid from said thread passages formed by said thread passage segments.

39. A device as in claim 38, wherein said second fluid is air.

40. A device as in claim 39, wherein said second fluid has a pressure of less than 5 bar.

41. A device as in claim 39, wherein said second fluid has a pressure of about 0.5 bar.

42. A texturing device for texturing a thread with a false twist, said device comprising:

a heat exchanger for transferring heat to said thread, said heat exchanger having a first section and a second section operably disposed to one another and forming a chamber into which a first fluid flows to treat said thread;

wherein said first and second sections of said heat exchanger are sealable in such a manner that thread passages formed by said first section including an inlet passage and an outlet passage seal around said thread to prevent leakage of said first fluid from said chamber while allowing thread to be movable through said heat exchanger; and wherein said second section is a tube operably connecting an inlet.

43. A device as in claim 42, wherein said first section and said tube of said heat exchanger are manipulatable in such a manner that said thread passages formed by said first section are enlarged to facilitate insertion of the thread into said heat exchanger.

44. A device as in claim 42, wherein at least one nozzle is operably disposed to a thread passage formed by said first section to facilitate conduction of said thread through said thread passages.

45. A device as in claim 44, wherein said at least one nozzle creates a suction for pulling said thread through the heat exchanger.

46. A device as in claim 44, wherein said at least one nozzle blows said thread through the heat exchanger.

47. A texturing device for texturing a thread with a false twist, said device comprising:

a heat exchanger for transferring heat to said thread, said heat exchanger having a first section and a second section operably disposed to one another and forming a chamber into which a first fluid flows to treat said thread;

at least two thread passage segments operably disposed to said first and second sections of said heat exchanger, said thread passage segments forming thread passages through which said thread is movable within said heat exchanger;

wherein said first and second sections of said heat exchanger are manipulatable in such a manner that said thread passages formed by said thread passage segments are enlarged to facilitate insertion of the thread into said heat exchanger;

wherein said first and second sections of said heat exchanger are sealable in such a manner that said thread passages formed by said thread passage segments seal around said thread to prevent leakage of said first fluid from said chamber while allowing thread to be movable through said heat exchanger; and wherein said thread passage segments are movably arranged to open said thread passages in an axial direction.

48. A texturing device for texturing a thread with a false twist, said device comprising:

a heat exchanger for transferring heat to said thread, said heat exchanger having a first section and a second section operably disposed to one another and forming a chamber into which a first fluid flows to treat said thread;

at least two thread passage segments operably disposed to said first and second sections of said heat exchanger, said thread passage segments forming thread passages through which said thread is movable within said heat exchanger;

wherein said first and second sections of said heat exchanger are manipulatable in such a manner that said thread passages formed by said thread passage segments are enlarged to facilitate insertion of the thread into said heat exchanger;

wherein said first and second sections of said heat exchanger are sealable in such a manner that said thread passages formed by said thread passage segments seal around said thread to prevent leakage of said first fluid from said chamber while allowing thread to be movable through said heat exchanger; and wherein said thread passage segments are movably arranged to open said thread passages in a radial direction.

49. A texturing device for texturing a thread with a false twist, said device comprising:

a heat exchanger for transferring heat to said thread, said heat exchanger having a first section and a second section operably disposed to one another and forming a chamber telescopically variable in length into which a first fluid flows to treat said thread;

at least two thread passage segments operably disposed to said first and second sections of said heat exchanger, said thread passage segments forming thread passages through which said thread is movable within said heat exchanger; and wherein said first and second sections of said heat exchanger are sealable in such a manner that said thread passages formed by said thread passage segments seal around said thread to prevent leakage of said first fluid from said chamber while allowing thread to be movable through said heat exchanger.

50. A device as in claim 49, wherein said chamber formed by said first and second sections telescopically shortens in length to facilitate insertion of the yarn.

51. A device as in claim 49, wherein at least one injector nozzle is operably disposed to a thread passage formed by said thread passage segments to facilitate conduction of said thread through said thread passages.

52. A process for texturing a thread within a false twist texturing device with a heat exchanger, said process comprising the steps of:

manipulating the heat exchanger in a manner so that thread passages formed within the heat exchanger are enlarged;

inserting the thread into the heat exchanger by blowing the thread through the thread passages by means of an auxiliary airflow;

sealing the heat exchanger so that the thread passages seal around the thread providing enough space around the thread so that the thread is movable;

flowing a first fluid through a chamber formed by the heat exchanger between the thread passages; and moving the thread through the heat exchanger as the fluid flows through the chamber to treat the thread.

* * * * *